US007785430B2

(12) United States Patent
Hahma

(10) Patent No.: US 7,785,430 B2
(45) Date of Patent: Aug. 31, 2010

(54) METHOD OF IMPROVING THE BURN RATE AND IGNITABILITY OF ALUMINIUM FUEL PARTICLES AND ALUMINUM FUEL SO MODIFIED

(75) Inventor: Arno Hahma, Aura (FI)

(73) Assignee: Totalforsvarets Forskningsinstitut, Stockholm (SE)

( * ) Notice: Subject to any disclaimer, the term of this patent is extended or adjusted under 35 U.S.C. 154(b) by 1312 days.

(21) Appl. No.: 10/534,023

(22) PCT Filed: Nov. 28, 2003

(86) PCT No.: PCT/SE03/01842

§ 371 (c)(1),
(2), (4) Date: May 6, 2005

(87) PCT Pub. No.: WO2004/048295

PCT Pub. Date: Jun. 10, 2004

(65) Prior Publication Data

US 2006/0101713 A1 May 18, 2006

(30) Foreign Application Priority Data

Nov. 28, 2002 (SE) ..... 0203520

(51) Int. Cl.
*C06B 45/30* (2006.01)

(52) U.S. Cl. ..... 149/5; 44/542

(58) Field of Classification Search ..... 149/5; 44/542

See application file for complete search history.

(56) References Cited

U.S. PATENT DOCUMENTS 4,017,342 A 4/1977 Geisler et al.
5,391,239 A * 2/1995 Boulos ..... 148/253

* cited by examiner

*Primary Examiner*—Helene Klemanski
(74) *Attorney, Agent, or Firm*—Jacobson Holman PLLC

(57) ABSTRACT

A method of improving the burn rate and ignitability of aluminium fuel particles, and a thus modified aluminium fuel for use in propellant and explosive compositions and pyrotechnic charges. Aluminium fuel particles are treated with an aqueous solution of hydrofluoric acid and a fluoride and/or complex fluoride salt of an alkali metal and/or alkaline earth metal to form a surface layer of a fluoride complex bound to the aluminium fuel particle.

11 Claims, 6 Drawing Sheets

METHOD OF IMPROVING THE BURN RATE AND IGNITABILITY OF ALUMINIUM FUEL PARTICLES AND ALUMINUM FUEL SO MODIFIED

This is a nationalization of PCT/SE03/001842 filed Nov. 28, 2003 and published in English.

The invention relates to a method of improving the burn rate and ignitability of aluminium fuel particles and also a thus modified aluminium fuel for use in propellant and explosive compositions and pyrotechnic charges.

Particulate aluminium fuel, for instance in the form of powder, flakes or fibres, is used, inter alia, in rocket propellant to achieve a high specific impulse and in explosive compositions to increase the capacity of the charge. A drawback of aluminium fuel is that it requires a very high ignition temperature. A first condition for combustion is that the oxidising agent, i.e. oxidising gases, can come into contact with the fuel. Aluminium has naturally a protective oxide layer on its surface. It is this oxide layer that allows aluminium to mix with oxidisers and explosives in propellant and explosive compositions without any great risks since the element in itself is highly reactive. However, the oxide layer is a great obstacle in combustion since it prevents the oxidising agent from coming into contact with the fuel. The surface of the aluminium particle must usually be heated until the oxide layer evaporates, which requires a temperature above 2000° C. Such a high temperature must also be maintained during the entire combustion process since otherwise a new oxide layer forming extinguishes the aluminium particle. The high temperature must initially be provided by combustion of other energetic materials in the composition, which restricts the possible choice of these materials. Also a small reduction of the ignition temperature makes a great difference in the ignitability of the aluminium fuel. If the limit temperature can be lowered by just some hundred degrees, it means that a much larger number of energetic materials can effectively ignite the aluminium fuel.

It is previously known to mix fluorides, above all alkali metal fluorides, in propellant compositions containing metal fuel in order to improve the combustion properties of the composition. However, quite large additions have been required for effect. Since metal fluorides in themselves are not an energetic material, large additions of fluoride result in a reduction of the performance of the composition.

U.S. Pat. No. 4,017,342 discloses a method of improving the combustion properties of aluminium powder by treating the powder with hydrogen fluoride gas. The gas molecules are said to diffuse through the oxide layer and react with the pure aluminium underneath and, after treatment for some time, result in an aluminium fluoride coating, which lowers the ignition temperature of the metal powder and increases its burn rate. However, the method suffers from process-technical drawbacks since it is a gas-solid phase reaction that involves the handling of a highly aggressive hydrogen fluoride gas.

The object of the present invention is to provide additional improvement of ignitability and burn rate of a particulate aluminium fuel. Another object is to provide an improved aluminium fuel by a simple treatment of aluminium fuel particles with an aqueous solution.

This is achieved by a method and an aluminium fuel as defined in the claims.

According to the invention, the particulate aluminium fuel is treated with an aqueous solution of hydrofluoric acid and a fluoride and/or complex fluoride salt of an alkali metal and/or an alkaline earth metal. The solution reacts with the oxide layer of the particle and causes a surface layer of a fluoride complex on the fuel particle.

When igniting the particle, the fluoride complex melts and dissolves any rests of the oxide layer and then evaporates at a relatively low temperature so that pure aluminium is exposed to reaction with oxidising gases.

The process is simple to perform. Aluminium fuel particles, such as a powder, are brought into contact with the treatment solution, the powder being etched by the diluted hydrofluoric acid which can dissolve the aluminium oxide on the surface of the particles and replace oxygen atoms with fluorine. The aluminium is then dissolved as aluminium trifluoride in the acid but since at the same time the solution contains ions reacting with the produced aluminium fluoride to fluoride complex, a protective layer of this fluoride complex forms on the surface of the aluminium particles.

Preferably an aqueous solution is used, having the molar ratio 1:1 with regard to alkali metal/alkaline earth metal salt and hydrofluoric acid. The concentration of the solution with regard to fluoride may vary within wide limits, for instance 0.01-10 moles per litre. The aluminium particles can be added to the treatment solution, or the treatment solution can be added to a suspension of the aluminium particles in water. In the latter case, a more concentrated treatment solution is suitably used. The temperature can be 0-100° C. depending on the composition of the treatment solution. Some fluoride complexes, such as trisodium hexafluoroaluminate, are partly soluble in water and the solubility increases with increasing temperature, and therefore a lower treatment temperature, for instance 25-40° C., should be used in some cases. As will be illustrated below, however, the treatment solution can be modified with regard to the solubility of the fluoride complex so that also surface layers of partly soluble fluoride complexes can be produced at a higher temperature. The reaction temperature affects the thickness of the surface layer, and the surface layer will usually be thicker the higher the treatment temperature. A higher concentration of the solution also results in a thicker layer.

In the treatment, hydrogen gas develops for a short period as the reaction starts. The coating forms very quickly and the process stops by itself when a protective layer of fluoride complex has formed on the surface of the particles. The fuel particles can then be filtered off from the solution and dried. In the process, it must be ensured that the solution remains acidic in order to prevent a basic reaction between hydroxide ions and aluminium.

Suitable alkali metal fluorides in the treatment solutions are sodium, potassium, rubidium or cesium fluoride. Sodium or potassium is particularly preferred. When the counter-ion is sodium, a surface layer of cryolite forms, which is a well-known solvent for aluminium oxide. When the counter-ion is potassium, the process is still easier to perform since the formed surface coating, tripotassium hexafluoroaluminate, has less solubility in the acid solution than cryolite. The surface layer will be denser and protects the fuel particle in a better way. Tripotassium hexafluoroaluminate melts at a lower temperature than cryolite and causes a greater reduction of the ignition temperature of the aluminium fuel.

The complex fluoride in the treatment solution preferably is a hexafluoroaluminate, $AlF_6^{3-}$, or a hexafluorosilicate, $SiF_6^{2-}$. When the treatment solution contains, in addition to HF, merely an alkali metal fluoride, a relatively large amount of aluminium must be dissolved from the aluminium particles in the reaction before the solution is saturated and the fluoride complex begins to form on the surface of the particles. If the treatment solution contains a complex fluoride even from the beginning, the need for dissolved aluminium decreases and the precipitation of the fluoride complex starts more quickly. Hexafluorosilicate in the solution is incorporated in the formed fluoride complex together with in situ formed and optionally added hexafluoroaluminate. The presence of complex fluoride in the treatment solution results in a denser coating, which makes the aluminium more stable to, for instance, moisture and air. The surface layer can also be made thicker, which is particularly important when relatively coarse aluminium particles (>80 μm) are treated. A higher treatment temperature can be used when complex fluoride is present in the treatment solution. The solubility of complex fluorides increases with temperature and at +40° C. or higher, it is so high that it can be difficult to obtain a stable coating if the solution contains only hydrogen fluoride and alkali metal fluoride. The aluminium particles will be highly corroded instead. If the treatment solution is saturated in advance with complex fluoride, this problem disappears. The treatment temperature can be raised and thicker layers of fluoride complex can be produced.

If use is made of alkaline earth metals as counter-ion to the fluoride or the complex fluoride in the treatment solution, a surface layer will be obtained, which is much less soluble than in the case when alkali metal is used as counter-ion. This can be utilised in many ways. If, for instance, a very fine powder is available, and only as thin a coating of fluoride complex as possible is required, it is convenient to use an alkaline earth metal, such as magnesium, calcium or strontium, as counter-ion. Alkaline earth metal complex fluorides, for instance magnesium hexafluoroaluminate or magnesium hexafluorosilicate, can be added to the treatment solution when producing extremely thin surface layers. Extremely thin layers can be produced by low concentrations being used in the treatment solution. The presence of alkaline earth metal complex fluoride causes all dissolved aluminium to immediately precipitate as fluoride complex on the particles in spite of the low concentration.

The treatment solution may contain, in addition to hydrogen fluoride, mixtures in all combinations of two or more of alkali metal fluoride, alkaline earth metal fluoride, alkali metal complex fluoride and alkaline earth metal complex fluoride. Different combinations can be used to obtain a desired layer structure and layer thickness.

The layer structure can be controlled by the process being performed in several steps by components, which result in a fluoride complex which is more difficult to dissolve, being added to the treatment solution as the treatment proceeds. The process can be started, for instance, with a treatment solution containing HF and alkali metal fluoride, after which alkaline earth metal fluoride and/or alkaline earth metal complex fluoride is added. Alkaline earth metal ions can also be added in the final stage of the process to "empty" the solution of dissolved complex fluoride, which causes a thicker surface layer on the aluminium particles and a smaller amount of remaining fluoride in the waste solution. The added alkaline earth metal salt does not, in that case, have to be a fluoride or complex fluoride but can be an arbitrary, soluble alkaline earth metal salt, such as calcium chloride.

TG analyses performed in oxygen demonstrate that after treatment the fuel particles are at least three, and in some cases fifty, times more reactive than before treatment. Aluminium powder treated in this manner can be ignited in air by being heated with a Bunsen burner, which is not possible with untreated aluminium.

The invention will be described below by way of examples and TG graphs (Thermogravimetric) for the aluminium fuel particles produced according to the Examples and, for comparison, TG graphs for untreated aluminium powder and aluminium powder treated with hydrofluoric acid only. The TG graphs illustrate the percentage increase of the weight of the particles as a function of the temperature when heating a particle sample in oxygen atmosphere at a selected constant heating rate. The increase in weight indicates how the sample has oxidised at different temperatures. 188% corresponds to a complete oxidation of the aluminium powder to $Al_2O_3$. In all cases, the heating rate was 20° C./min; the initial temperature was 100° C. and the final temperature 1100° C. The supply of oxygen was 50 ml/min in all cases.

EXAMPLE 1

Figure 1:
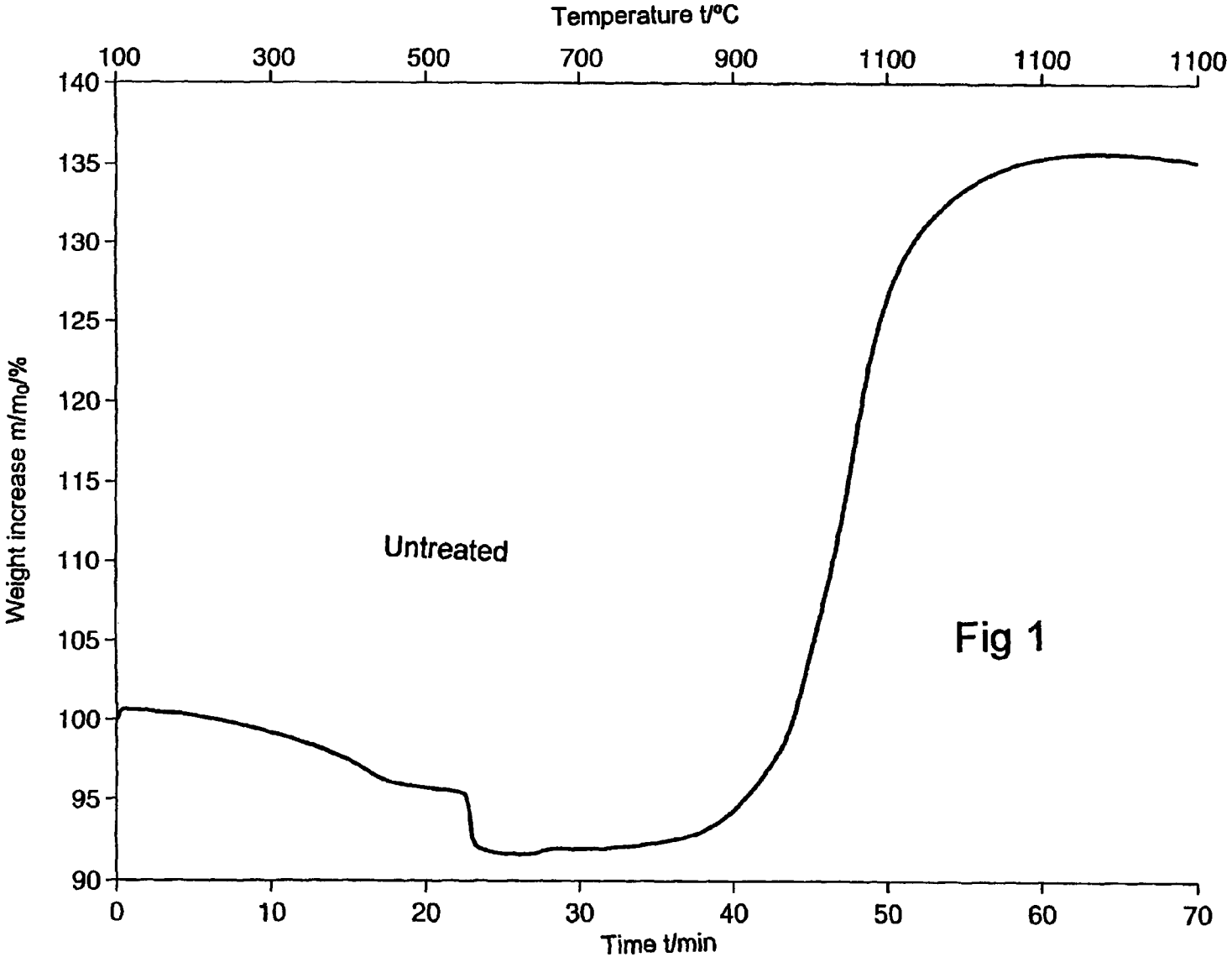
FIG. 1 shows a TG graph for untreated Al powder.
Figure 2:
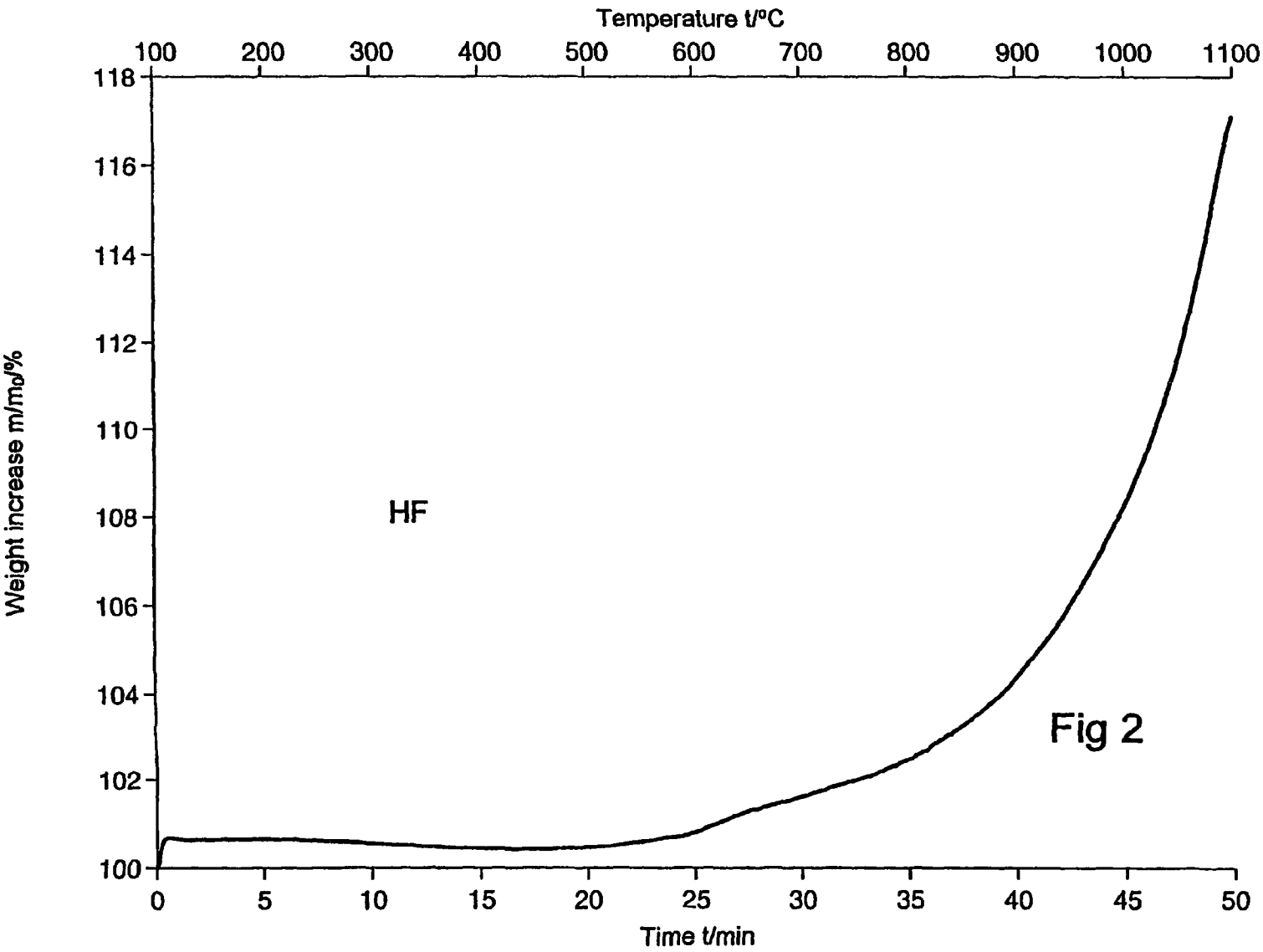
FIG. 2 shows a TG graph for Al powder treated with hydrofluoric acid.
Figure 3:
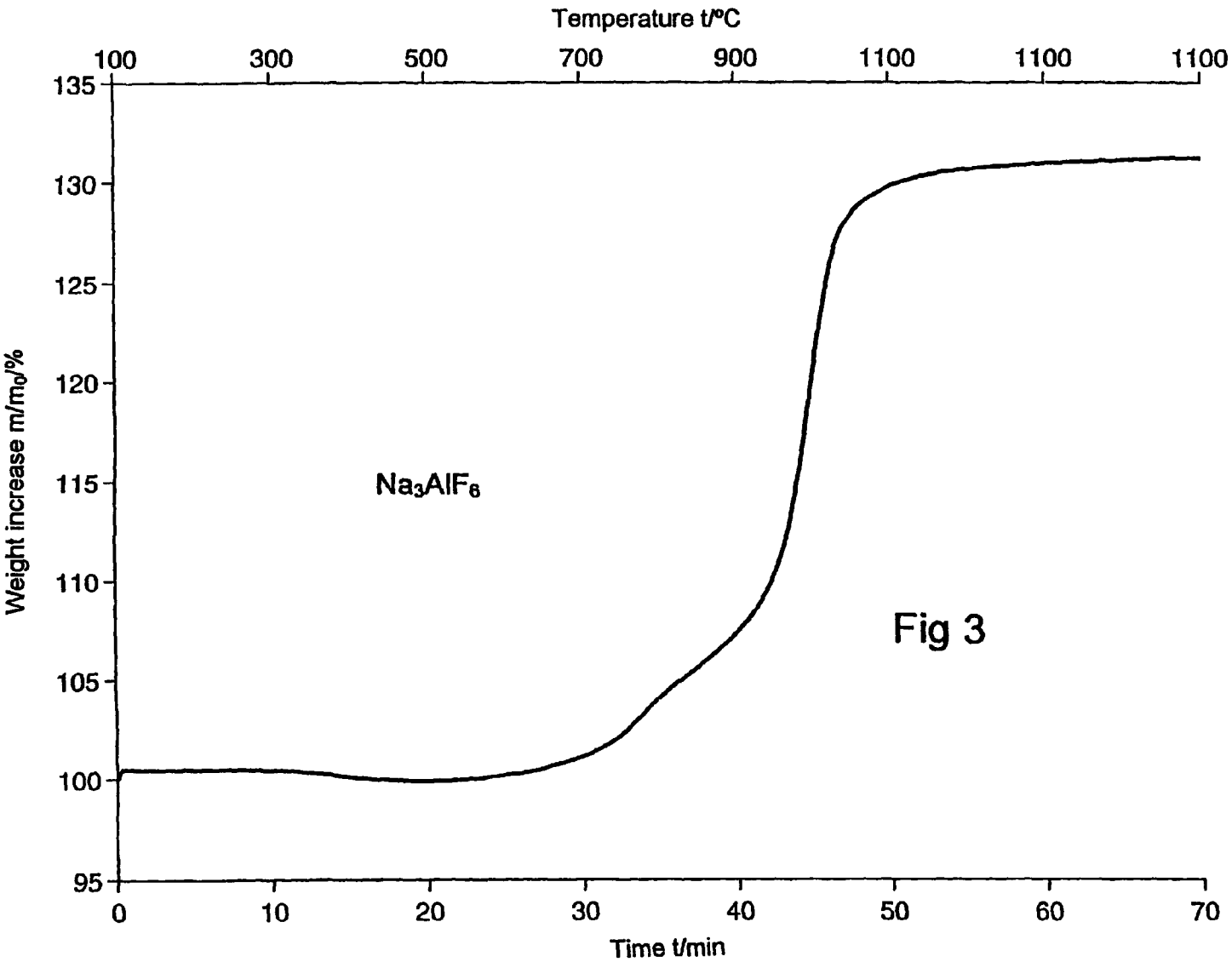
FIG. 3 shows a TG graph for Al powder with a surface layer of trisodium hexafluoroaluminate (cryolite) according to the invention.

A solution of HF and NaF at a molar ratio of 1:1 was added to a suspension of aluminium powder (Carlfors Bruk A100) in pure water at a temperature of 30° C. The total concentration of fluoride in the solution was 0.5 M and the total amount of added fluoride was 2% of the molar amount of the aluminium. The fluoride solution was added to the suspension of aluminium powder under rigorous agitation. The rate of adding was controlled to prevent excessive frothing owing to generation of hydrogen. As soon as all the fluoride solution had been added, agitation was stopped and the powder was filtered off and dried. A surface layer of trisodium hexafluoroaluminate (cryolite) had formed on the particles. FIG. 3 shows the TG graph for the thus treated powder. As is evident from the graph, reactivity increases at a lower temperature compared with untreated powder (FIG. 1) and powder treated with HF only (FIG. 2).

The method was repeated with suspensions of aluminium powder in pure water at temperatures between 0° C. and 100° C. Owing to the solubility of the formed fluoride complex at a higher temperature, a treatment temperature of from 25° C. to 40° C. was preferred. The total concentration of fluoride in the added solution varied between 0.01 and 10 M. A preferred concentration was 0.1-5 M and preferably 0.2-1 M. The total amount of added fluoride varied between 0.01% and 10% of the molar amount of the aluminium. A preferred addition was 0.1-5% and most preferably 0.5-2%.

Powder treated in this manner burnt 5-10 times more quickly than untreated powder of the same particle size and shape.

EXAMPLE 2

Figure 4:
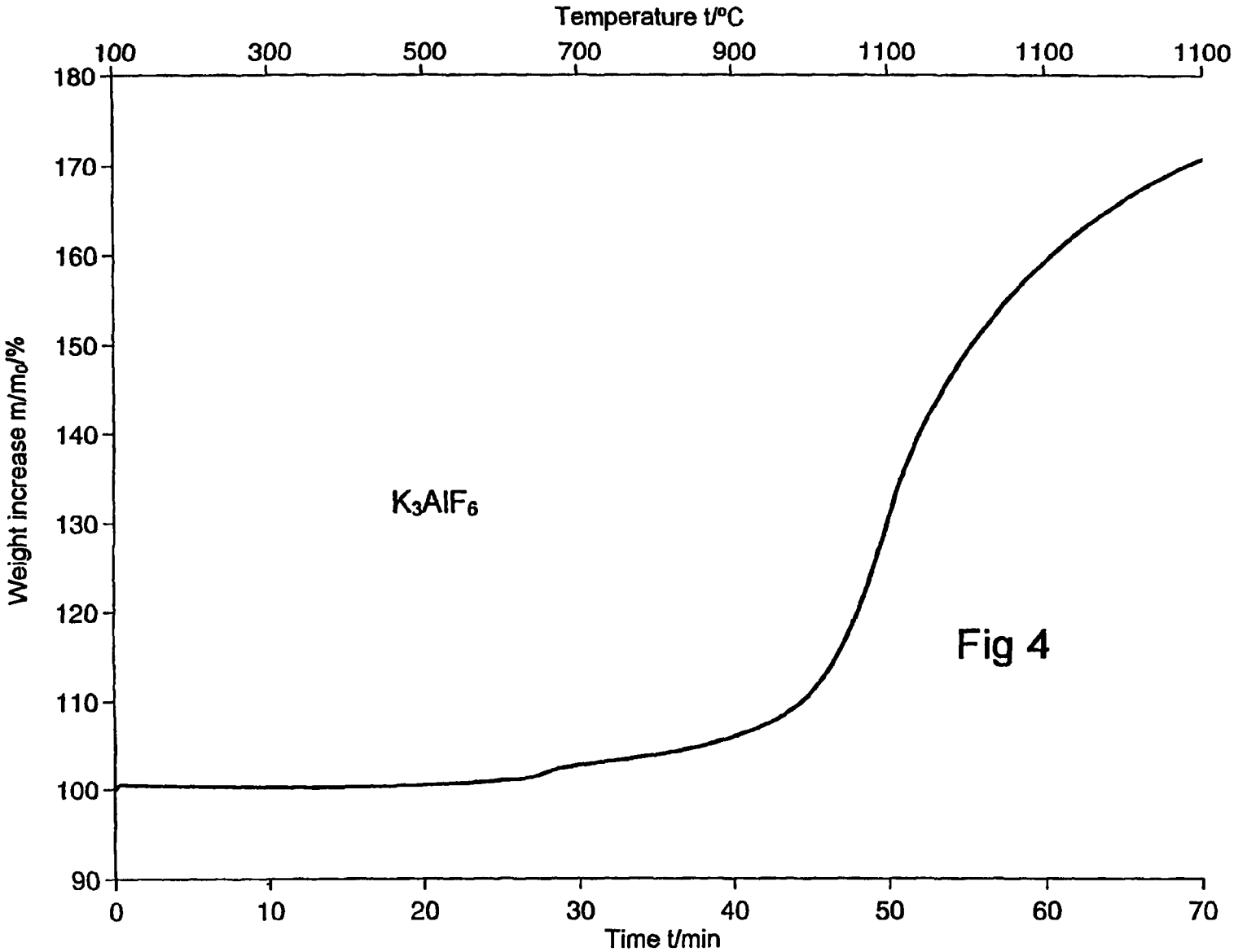
FIG. 4 shows a TG graph for Al powder with a surface layer of tripotassium hexafluoroaluminate according to the invention.

Repeated treatments were made by a solution of HF and KF at a molar ratio of 1:1 being added to suspensions of aluminium powder (Carlfors Bruk A100) in pure water at temperatures from 10° C. to 80° C. The total concentration of fluoride in the treatment solutions varied between 0.1 and 5 M and the total amount of added fluoride was 0.1-5% of the molar amount of the aluminium. The fluoride solution was added to the suspension of aluminium powder under vigorous agitation, and the powder was filtered off and dried as soon as all fluoride solution had been added. A surface layer of tripotassium hexafluoroaluminate formed on the particles. FIG. 4 shows the TG graph for the thus treated powder where the total amount of added fluoride was 2%.

Powder treated in this manner burnt 10-20 times more quickly than untreated powder of the same particle size and shape.

EXAMPLE 3

Figure 5:
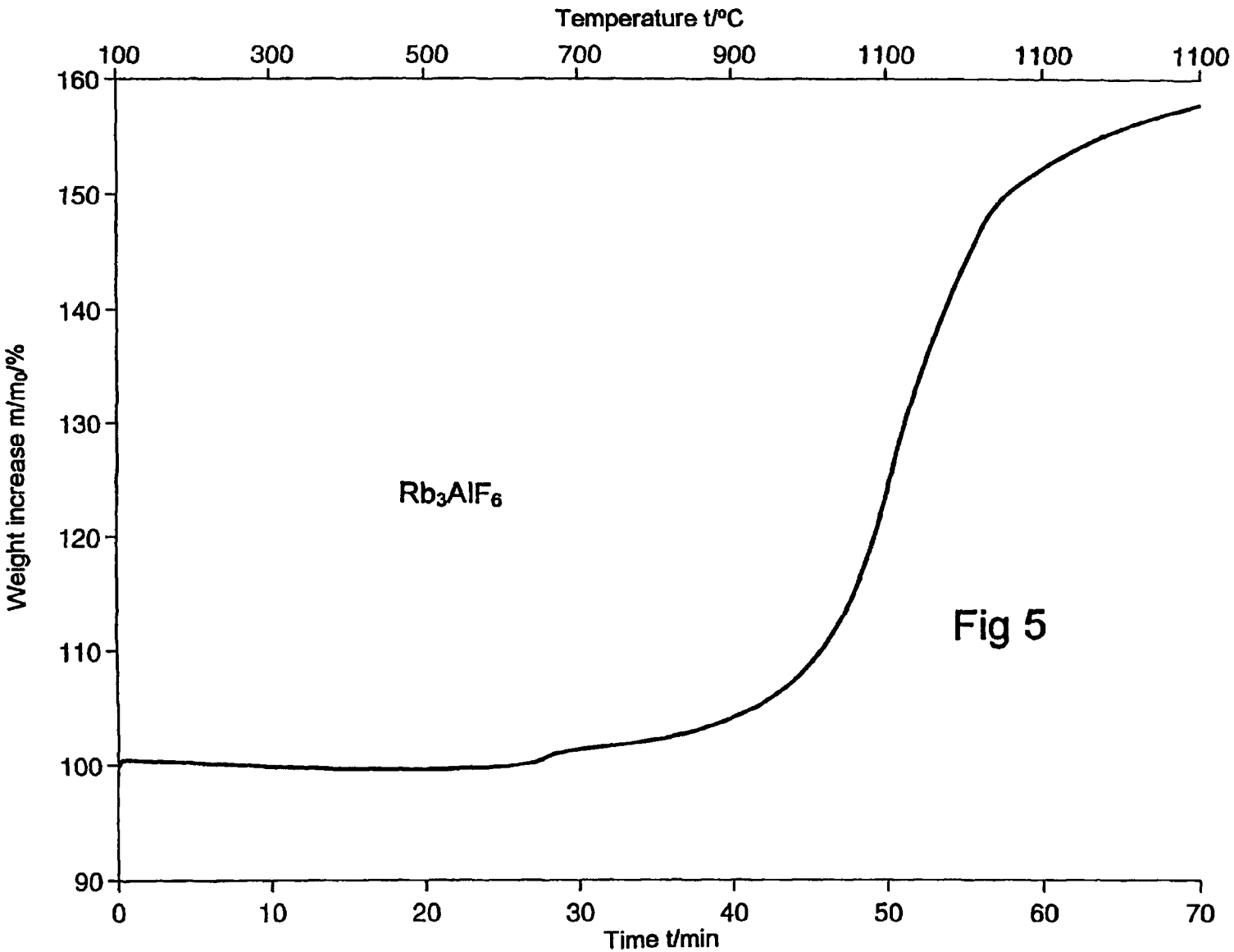
FIG. 5 shows a TG graph for Al powder with a surface layer of trirubidium hexafluoroaluminate according to the invention.

Example 2 was repeated, but with a treatment solution consisting of HF and LiF. FIG. 5 shows a TG graph for a thus treated powder where the total amount of added fluoride was 2%. The powder burnt 10-20 times more quickly than untreated powder of the same particle size and shape.

EXAMPLE 4

Figure 6:
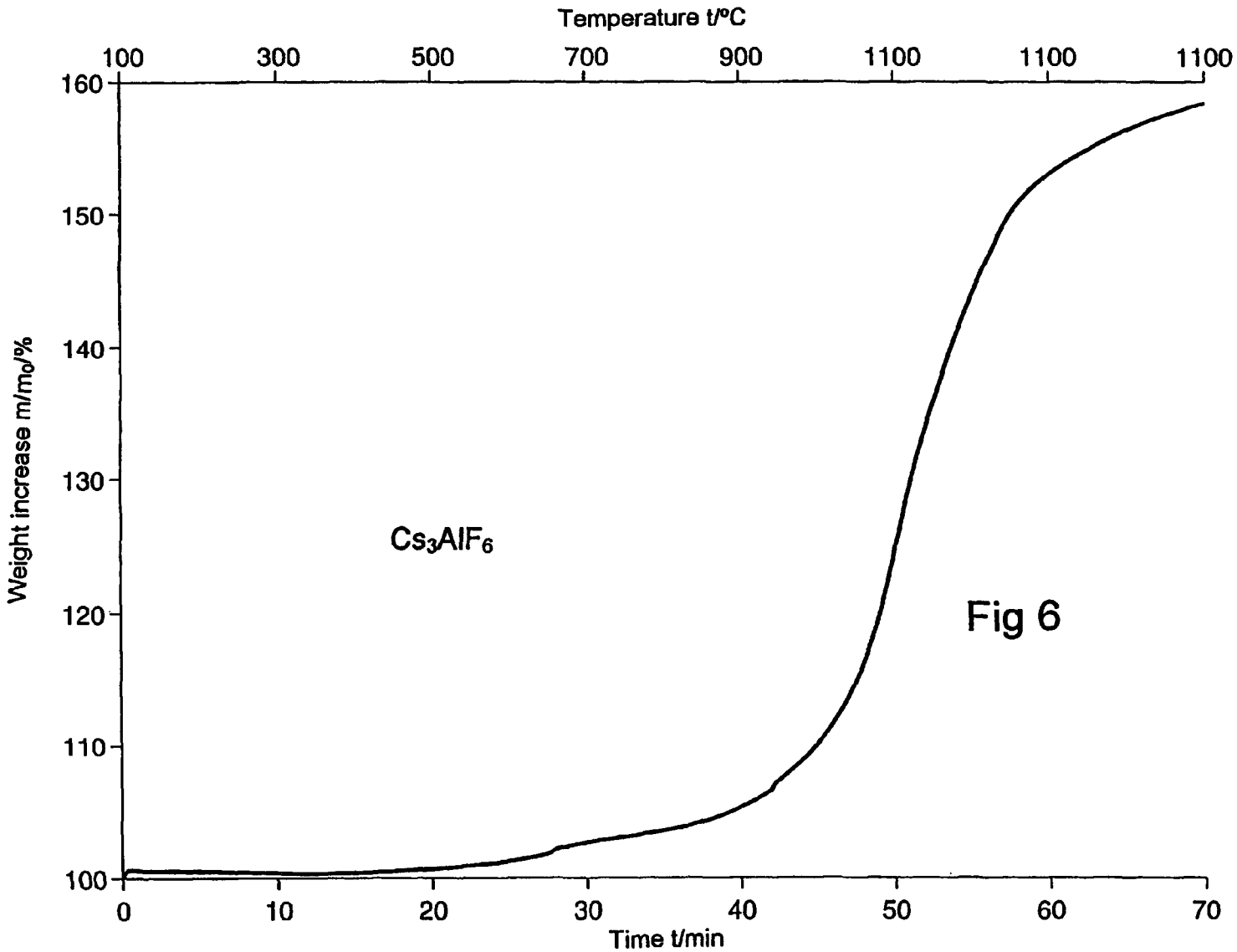
FIG. 6 shows a TG graph for Al powder with a surface layer of tricesium hexafluoroaluminate according to the invention.

Example 2 was repeated, but with a treatment solution consisting of HF and RbF. FIG. 6 shows a TG graph for a thus treated powder where the total amount of added fluoride was 2%. The powder burnt 10-20 times more quickly than untreated powder of the same particle size and shape.

EXAMPLE 5

Example 2 was repeated, but with a treatment solution consisting of HF and CsF. FIG. 7 shows a TG graph for a thus treated powder where the total amount of added fluoride was 2%. The powder burnt 10-20 times more quickly than untreated powder of the same particle size and shape.

EXAMPLE 6

A solution containing HF and KF (at a molar ratio of 1:1) and $H_2SiF_6$ was added to a suspension of aluminium powder (Carlfors Bruk A100) in pure water at a temperature of about 80° C. The fluoride/complex fluoride solution was added to the suspension of aluminium powder under vigorous agitation. As soon as all the treatment solution had been added, agitation was stopped and the powder was filtered off and dried. A fluoride complex containing hexafluoroaluminate and hexafluorosilicate had formed on the particles. The procedure was repeated at different temperatures between 0° C. and 100° C. of the aluminium powder suspension. A higher treatment temperature resulted in a thicker surface layer.

Powder treated in this way burnt 30-50 times more quickly than untreated powder of the same particle size and shape.

EXAMPLE 7

Example 6 was repeated, but instead of $H_2SiF_6$, $SiO_2$ in fine powder form was added to the treatment solution. The silicon dioxide reacted with the other components in the treatment solution and formed hexafluorosilicate in situ. A fluoride complex of the same type as in Example 6 formed on the particles.

EXAMPLE 8

Example 2 was repeated, but a $CaCl_2$ solution was added at the end of the treatment. A thicker surface layer formed when $CaCl_2$ was added to the treatment solution than in the case where merely HF and KF were used at the same temperature. The fluoride complex on the particles contained potassium and calcium hexafluoroaluminate. Powder treated in this manner burnt 30-50 times more quickly than untreated powder of the same particle size and shape. The residual solution from the treatment contained very small contents of dissolved hexafluoroaluminate.

EXAMPLE 9

A solution containing HF and KF (at a molar ratio of 1:1), which had been saturated with $Na_3AlF_6$, was added to a suspension of aluminium powder (Carlfors Bruk A100) in pure water at a temperature of about 80° C. The fluoride/complex fluoride solution was added to the suspension of aluminium powder under vigorous agitation. As soon as all the treatment solution had been added, agitation was stopped and the powder was filtered off and dried. The procedure was repeated at different temperatures between 0° C. and 100° C. Thicker layers of trisodium hexafluoroaluminate (cryolite) were obtained when the treatment solution had been saturated in advance with cryolite, and thicker layers could be provided at higher temperatures.

Powder treated in this manner burnt 10-20 times more quickly than untreated powder of the same particle size and shape.

The invention claimed is:

1. A method of producing aluminum fuel particles having improved ignitability and burn rate, comprising treating the aluminum fuel particles with an aqueous solution of hydrofluoric acid and (i) a fluoride or (ii) a complex fluoride of at least one of an alkali metal and an alkaline earth metal to form a surface layer of a fluoride complex bound to the aluminum fuel particles.

2. The method as claimed in claim 1, wherein an alkaline earth metal ion is added to the aqueous solution in a final stage of the treatment.

3. The method as claimed in claim 1, wherein the alkali metal fluoride is selected from the group consisting of sodium, potassium, rubidium, and cesium fluoride.

4. The method as claimed in claim 1, wherein the complex fluoride is a hexafluoroaluminate or a hexafluorosilicate.

5. The method as claimed in claim 1, wherein the alkali metal fluoride is sodium fluoride and the fluoride complex is cryolite.

6. The method as claimed in claim 1, wherein the alkali metal fluoride is potassium fluoride and the fluoride complex is tripotassium hexafluoroaluminate.

7. Aluminum fuel particles for propellant and explosive compositions and pyrotechnic charges, said aluminum fuel particles comprising a surface layer of a fluoride complex provided by treatment of the aluminum fuel particles with an aqueous solution of hydrofluoric acid and (i) a fluoride or (ii) a complex fluoride of at least one of an alkali metal and an alkaline earth metal.

8. The aluminum fuel particles as claimed in claim 7, wherein the alkali metal fluoride is selected from the group consisting of sodium, potassium, rubidium, and cesium fluoride.

9. The aluminum fuel particles as claimed in claim 7, wherein the complex fluoride is a hexafluoroaluminate or a hexafluorosilicate.

10. The aluminum fuel particles as claimed in claim 7, wherein the alkali metal fluoride is sodium fluoride and the fluoride complex is cryolite.

11. The aluminum fuel particles as claimed in claim 7, wherein the alkali metal fluoride is potassium fluoride and the fluoride complex is tripotassium hexafluoroaluminate.

* * * * *